United States Patent [19]

Welsh

[11] Patent Number: 4,779,442

[45] Date of Patent: Oct. 25, 1988

[54] METHOD AND APPARATUS FOR MEASURING FORCES ON A WORKPIECE DURING DRAWING OR IRONING

[75] Inventor: Robert E. Welsh, Pittsburgh, Pa.

[73] Assignee: Aluminum Company of America, Pittsburgh, Pa.

[21] Appl. No.: 48,832

[22] Filed: May 12, 1987

[51] Int. Cl.[4] ..... B21D 22/21

[52] U.S. Cl. ..... 72/347; 72/20; 72/273

[58] Field of Search ..... 72/19, 20, 273, 347, 72/349

[56] References Cited

U.S. PATENT DOCUMENTS 4,589,270 5/1986 Lee, Jr. et al. ..... 72/347

OTHER PUBLICATIONS

Mechanical Testing, Section 8, "Miscellaneous Mechanical Tests", pp. 923 and 924.

*Primary Examiner*—W. Donald Bray

*Attorney, Agent, or Firm*—Max L. Williamson; Thomas J. Connelly

[57] ABSTRACT

A method and apparatus for measuring the sidewall tension in a workpiece being drawn through a draw die and/or ironing die. A punch is provided which is adapted to measure and continuously monitor the axial load on the punch nose and the total axial load on the punch, the distribution of such loads around the periphery of the punch, and bending of the punch near the base and nose due to lateral and nonuniform forces acting on the punch as the workpiece is forced through a die or dies. Determination of the forces, their distribution, and punch bending enables accurately determining the tensile stress at any portion of the sidewall.

23 Claims, 4 Drawing Sheets

METHOD AND APPARATUS FOR MEASURING FORCES ON A WORKPIECE DURING DRAWING OR IRONING

BACKGROUND OF THE INVENTION

This invention relates to drawing or drawing and ironing a workpiece. More particularly, it relates to a method and the apparatus for continuously measuring the axial forces and bending moments imposed on the nose of a punch and on the punch base as the punch forces the workpiece through a draw die or ironing die. Measuring such forces makes it possible to determine 1) the axial force sustained by the just-formed workpiece sidewall emerging from the die, and 2) the friction generated along the interface of the punch and the workpiece sidewall.

When a metal blank is drawn or drawn and ironed into an open end article, such as a can body, it is desirable to maximize efficiency of material usage in the part while minimizing the percentage of defective parts produced.

A common defect resulting from the drawing and ironing processes is fracture of the sidewall at the die exit. A number of variables affect the forming stresses and strains which control fracture. Examples of such variables are the microstructure and properties of the metal being formed, and process variables such as lubrication and the reductions in diameter and sidewall thickness required to form the finished article. For example, if the percent draw reduction (diameter reduction) or ironing reduction (sidewall thickness reduction) attempted in an operation is increased while leaving other variables unchanged, higher forming strains and stresses result. If the material and process are such that the sidewall's tensile stress at the die exit exceeds its ultimate strength, the sidewall will fracture. Reducing the exiting sidewall stress, therefore, lessens the probability of a fracture. Fractures may indicate that a modification in the forming procedure or the workpiece material is desirable to efficiently produce the article. Knowledge of the exiting sidewall's tensile stress under a range of forming process conditions, therefore, is beneficial in the design and selection of workpiece and tooling materials and surfaces, lubrication and other process variables.

In forming can bodies by drawing a cup followed by redrawing and one or more ironing operations, efforts have been made to determine the reformed sidewall's strength and the stress it sustains during deformation of the remainder of the sidewall. This tensile stress in the reformed sidewall varies along its length with its magnitude being the greatest at the die exit, where fractures often occur; sidewall strength provides a measured limit on this sidewall stress. Due to friction between the punch and reformed sidewall, tension decreases along the sidewall from a maximum at the die exit to a minimum at the sidewall juncture with the can bottom.

One method of determining allowable stresses in the sidewall has been to conduct uniaxial tension tests on sidewall specimens. This method is unsatisfactory since uniaxial tension properties of a sidewall specimen from a single location are not indicative of the actual sidewall forming stress or ultimate strength in drawing and drawing and ironing processes. The strain states in these processes are not uniaxial tension; ironing causes through-thickness plane-strain compression, in contrast to the in-plane stretching imposed by uniaxial tension tests. Since the length of a specimen required to perform a uniaxial tension test approaches or exceeds the height of the sidewall (depending on the forming stage in can making), only one uniaxial tension specimen can be taken at any circumferential location. The mechanical properties of the article both before and after reforming may vary around its circumference and along its length, however, due to the material's anisotropy imposed by prior processes in making the sheet and strain distribution from the article's manufacture. A uniaxial tension test of a sidewall specimen may not be indicative, therefore, of the yield stress in forming or the limiting stress which it may sustain. Neither can tension carried by the sidewall during forming be predicted from its incoming uniaxial yield strength, since process variables such as die profile, percent thickness reduction and frictional conditions and their variation around the circumference greatly influence this forming stress. Fracture occurs in uniaxial tension tests at thickness strains much below those routinely achieved in ironing, emphasizing the dissimilarity of the two deformation processes. Also, the fracture in the uniaxial tension test cannot be related to an actual failure location in can forming. For these reasons, the relevancy of yield and ultimate tensile strengths measured from uniaxial tension tests is doubtful. Forming and fracture stresses determined from direct measurements would provide more accurate, applicable information concerning the material, the process and the nature of the failure.

Another method which has been used in an effort to determine stress in the sidewall at the die exit involves measuring the punch base force during forming using a compressive load cell mounted between the press ram and the punch base. Punch base force is the axial force required to push the punch and workpiece through the die. The tensile stress in the exiting sidewall is computed as the measured punch base force divided by the cross-sectional area of the sidewall at the die exit. The value of this force measured at fracture is similarly used to determine the ultimate tensile strength of the sidewall at the fracture location. These calculated stresses significantly overestimate the sidewall stress at the die exit. The true sidewall tension is substantially less than the punch base force due to punch friction, which acts on the entire inner surface of the workpiece in the direction of punch motion. Although the known foregoing methods of determining stress in the sidewall have been beneficial in helping to select suitable materials and processing parameters, it may be seen that these methods do not yield results which accurately reflect the conditions under which an object is stressed during drawing or drawing and ironing. By a method of this invention, the axial forces on the punch base and nose are continuously measured as the punch forces a blank through one or more dies in drawing or drawing and ironing a workpiece. From these forces the actual tensile stress in the sidewall of the workpiece can be determined with a relatively high degree of accuracy.

In addition to measuring the axial forces on the punch nose and base, this invention includes a method to describe the distribution of sidewall tension and friction stresses around the circumference of the article, providing valuable information regarding the nonuniformity of the process conditions, e.g., lubrication, thickness reductions (punch/die alignment), etc., and regarding the nature and circumferential location of a fracture's initiation point.

This invention may be further adapted to measure the amount of bending of the punch near its nose and its base. In any process to form or reform a hollow article with a punch and die, any process or material nonuniformity around the periphery of the punch may result in imbalanced lateral and/or axial loading, applying a bending moment to the punch at various locations. For instance, process or material nonuniformity may produce, around the circumference, a variation in reformed sidewall tension at the punch nose; as a result, the punch nose will be unevenly loaded, generating a bending moment on the punch nose. By detecting this bending at the punch nose, the variation (both magnitude and orientation) in sidewall tension at the punch nose can be determined.

Similarly, process or material nonuniformity may produce variation (around the circumference) in the die friction and/or die pressure; as a result, a bending moment will arise at the punch base. This uneven loading will also cause a lateral deflection of the punch. By detecting the bending at the punch base, the imbalance in die friction and pressure which caused it can be determined. In addition, this invention proposes determining, from bending measured at the punch base, the magnitude of the lateral deflection of the punch as it travels through the die(s).

The variation in punch friction around the periphery of the punch may also be derived from variations in punch nose load and punch base load thus determined. The bending detected at the punch base may be thought of as a variation in punch base load around the circumference of the punch base. The punch base load value is subtracted from the corresponding punch nose load value for the same circumferential location, thereby calculating local values of punch friction.

This invention also proposes monitoring the axial forces and bending the punch nose and base in a production press, e.g., a can body forming press, to provide feedback signals for a computer-based process control system to indicate departure from safe ranges of sidewall tension and force distribution. Further, punch lateral deflection is monitored to provide feedback to indicate actual punch to die misalignment as the punch travels through the die(s) during drawing or drawing and ironing. This can permit real-time corrections of process variables or prompt needed press or tooling maintenance to decrease the total sidewall stress or excessive stress in a specific circumferential location before fractures occur to disrupt production. For example, aluminum pickup or wear on the punch or die causes plowing of longitudinal scratches in the inner or outer surfaces of the finished can, producing undesirable surface finish and cleaning problems. pickup or wear on the tools may cause higher forming forces which may generate higher sidewall stresses and produce stress concentrations in the scratches in the exiting sidewall. Both the generation of high sidewall stresses and stress concentrations are conditions that might lead to sidewall fractures. Progressive die pickup and wear may be detected as an increasing trend over time in total punch load and sidewall tension. Punch pickup or wear may be detected as an increase in punch friction. Sidewall tension and punch friction measurement, therefore, by a method of this invention, can indicate the need to replace worn punches and dies, e.g., draw, redraw and ironing dies.

Apparatus and a method of this invention for measuring the force and bending at the punch nose and at the punch base may be advantageous in a number of ways for any metal forming procedure which requires forcing a workpiece through a die with a punch, producing a hollow article. For example, when forming a deep-drawn article from flat sheet, determining such forces may be helpful in selection or evaluation of workpiece material or process variables such as the percent reduction in diameter to be made in a single draw. As another example, determining forces on the punch at sidewall fracture is helpful in determining the optimum amount of ironing that can be tolerated by a given material. Since the sidewall thickness is severely reduced during ironing, large tensile forces are generated in the reformed sidewall which can exceed its ultimate strength, resulting in a fracture. The ultimate tensile strength of the sidewall material in undergoing this process can be determined from measurement of the sidewall force at fracture by the method of this invention. To determine the ultimate strength, a fracture may be induced through modification of one or more process variables, e.g., greater thickness reduction. One efficient means to induce a fracture by ironing to excessive thickness reductions employs a punch which tapers slightly along part or all of its cylindrical surface with its greatest diameter near the base. Ironing with this tapered punch imposes ever-increasing thickness reductions and stresses along the sidewall of each workpiece until fracture occurs. A method of employing a tapered punch to induce fracture, and thus, investigate maximum ironing reductions, is the subject of a copending patent application Ser. No. 839,782, filed Mar. 14, 1986. Measuring sidewall tension by the method of this invention to determine fracture stress adds to the value of testing with a tapered punch. In this way, an upper limit is established on tolerable sidewall tension for the workpiece material tested. Similar tests can then be run with a punch of uniform outer diameter at different levels of each process variable, which may or may not regularly cause a fracture, to determine the resulting measured sidewall tension. Thus, the process can be utilized for establishing the optimum conditions for a variety of process variables. For example, the greatest practical thickness reduction can be determined by increasing reduction using a series of dies of smaller inner diameters until the resulting tension reaches a chosen percentage (less than 100) of the sidewall strength previously determined. Alternately, for the required reduction, the levels of process variables, such as die entry angle, can be optimized to minimize measured sidewall tension (and fracture frequency).

SUMMARY OF THE INVENTION

In drawing or drawing and ironing by a method of this invention, the magnitudes of the load or force, its distribution, and bending imposed on the nose of a punch while forcing a workpiece through a draw die or ironing die are continuously determined prior to, during and after the forming process. Concurrent with such measurement, the magnitudes of the total load or force, its distribution, and bending being imposed on the punch base are also continuously determined. Knowing the magnitudes and circumferential variations of these two forces enables calculation of the coincident values of two important parameters: namely, the tensile force distribution sustained by the reformed sidewall and the frictional force distribution between the punch and workpiece sidewall. Knowing the sidewall tensile force and the friction force between the punch and the sidewall is critical in quantitatively evaluating forming characteristics of differing workpiece materials, as well as the effect of different lubrication systems, material and topography of punch and die working surfaces, diameter and thickness reduction schedules, die profiles, and other process variables. Monitoring sidewall tension and punch friction not only aids in process design and fundamental understanding, but can also provide feedback in controlling production processes as well. In addition, monitoring bending at the punch base enables determining lateral deflection of the punch during its travel through the dies.

It is an objective of this invention to provide a method and apparatus for accurately determining the tensile force and its distribution in the sidewall of a workpiece as it is being drawn or ironed, and the residual tension in the sidewall after forming.

It is also an objective of this invention to determine the frictional force and its distribution between the punch and workpiece sidewall during and after reforming.

These and other objectives and advantages of the invention will be more evident with reference to the following description of a preferred embodiment and accompanying drawings.

DESCRIPTION OF A PREFERRED EMBODIMENT

Figure 1:
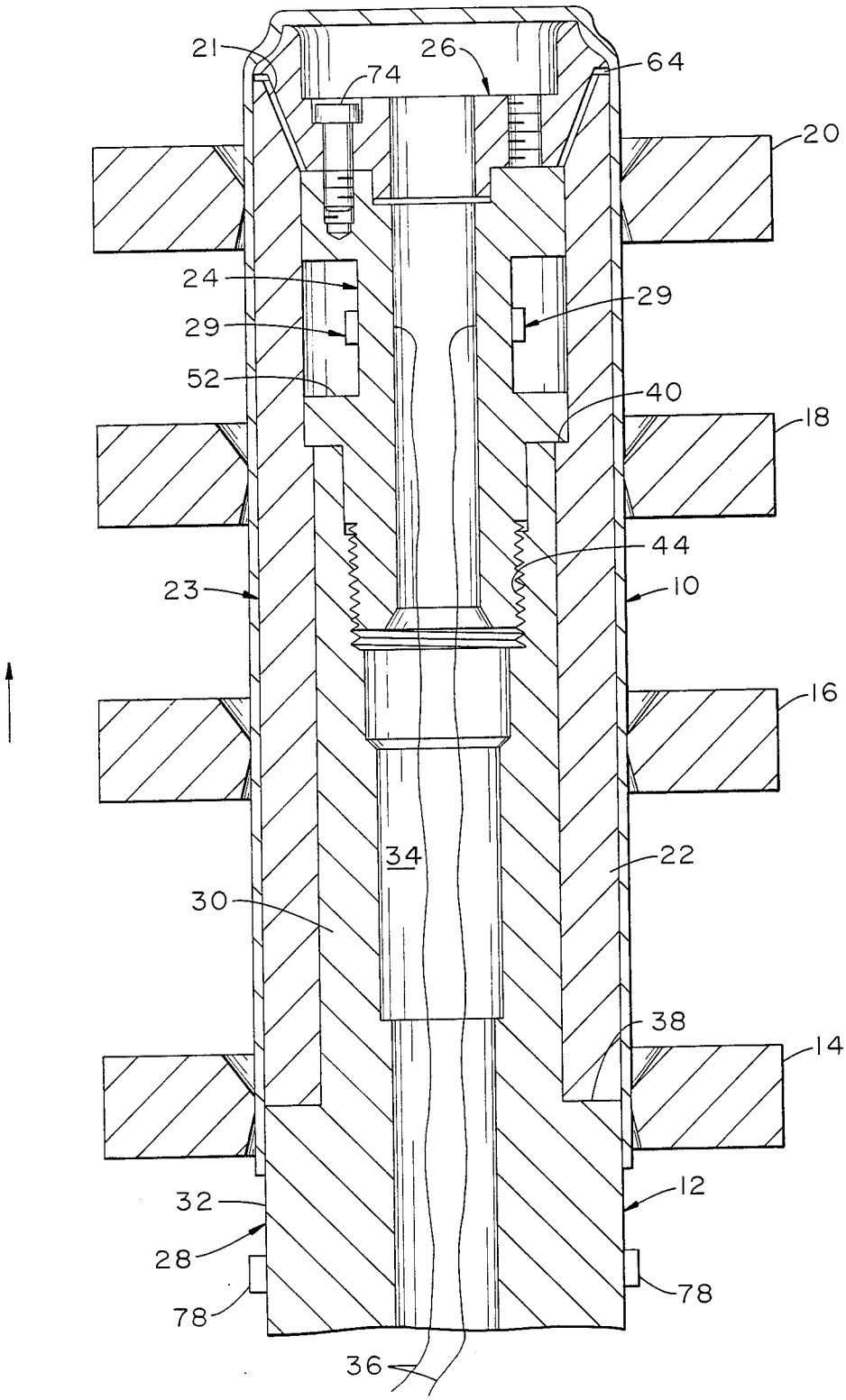
FIG. 1 is a cross-sectional view of a punch of this invention with a partially formed can body mounted thereon in transit through a redraw die and ironing dies in a can bodymaker press.

A preferred embodiment of this invention will be described with respect to drawing and ironing a can body. Referring now to the Figures, a partially formed can body 10 is mounted on a punch 12 and is shown in transit through a redraw die 14 and a first, second and third ironing die 16, 18, 20. The punch 12, redraw die 14 and ironing dies 16, 18, 20 are all mounted in coaxial alignment in a body forming press with the punch adapted for movement in the direction of the arrow. Details of mounting the redraw die 14 and ironing dies 16, 18, 20 are not shown for the sake of simplicity and such details are not needed for an understanding of the invention.

Figure 2:
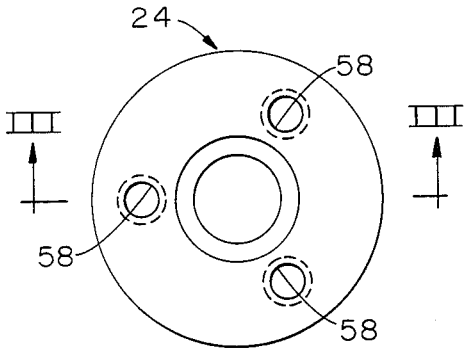
FIG. 2 is a plan view of a punch nose retainer of a punch of this invention.
Figure 4:
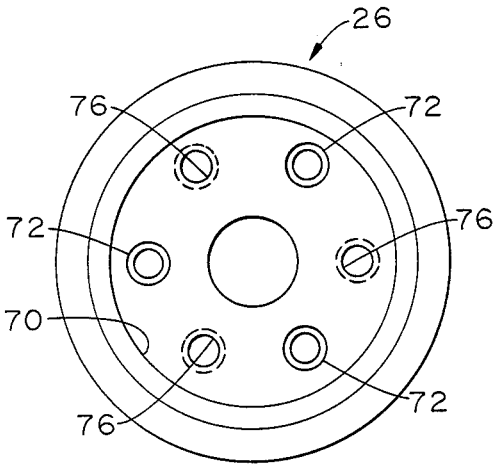
FIG. 4 is a plan view of a punch nose of a punch of this invention.
Figure 3:
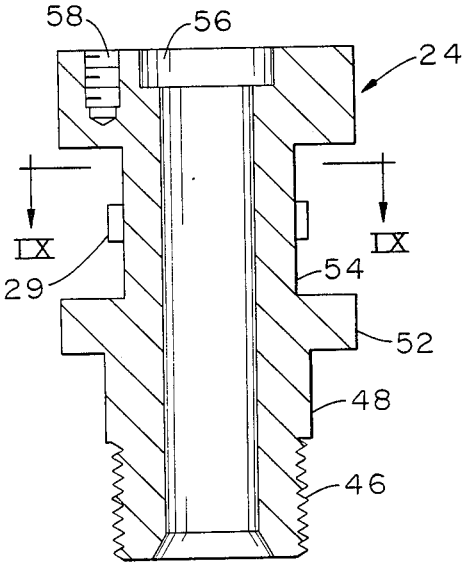
FIG. 3 is a cross-sectional view of the nose retainer shown in FIG. 2.
Figure 5:
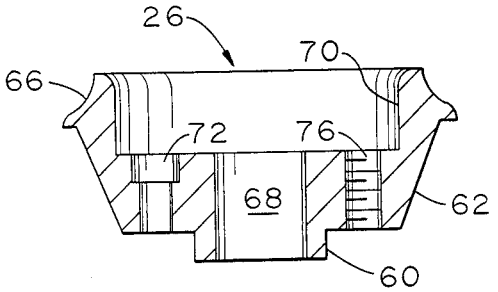
FIG. 5 is a cross-sectional view of the punch nose shown in FIG. 4.
Figure 9:
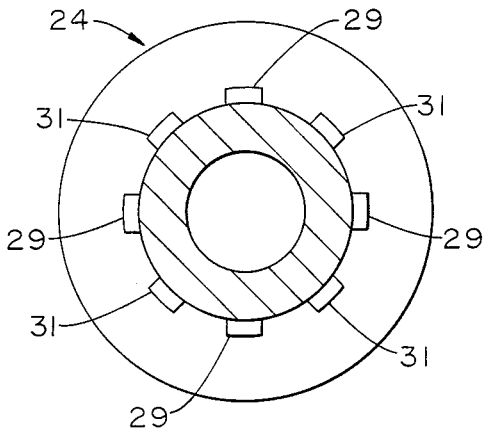
FIG. 9 is a cross-sectional view of the nose retainer shown in FIG. 3 showing the array of strain gauges therearound.

The punch 12 has a punch sleeve 22, a nose retainer 24 and a punch nose 26 mounted to a central mandrel 28. The nose retainer 24 clamps the punch sleeve 22 to the mandrel 28 while also providing accurate measurement of load carried by the punch nose, by virtue of strain gauges 29 affixed to its outer cylindrical surface. The central mandrel 28 has an elongate cylindrical shaft 30 terminating in a cylindrical base 32 having a greater outside diameter than the shaft. A center bore 34 extends through the mandrel 28, nose retainer 24 and punch nose 26 to provide a passageway for both the electrical leads 36 from the strain gauges on the nose retainer 24, and for compressed air, required after forming to push the can body off of the punch 12. The punch sleeve 22 is a hollow cylinder machined to fit closely around the shaft 30 and is supported by the shoulder 38 of the base 32 of the mandrel projecting outwardly from shaft 30. On an intermediate portion of the sleeve 22, slightly above the upper end of the mandrel shaft 30, the inner diameter is enlarged to provide a ledge 40. The ledge 40 provides a seat for the nose retainer 24, which threads into the tapped central bore 44 of the shaft 30, and functions to clamp the sleeve 22 onto the mandrel 28. The inside surface 21 of the sleeve adjacent the nose end tapers outwardly to accommodate the punch nose 26. The nose retainer 24, shown in FIGS. 2, 3 and 9, has a threaded end 46 for engagement with the tapped bore 44 of the shaft 30. A cylindrical segment 48 above the threaded end 46 has a larger outer diameter and is adapted for a close sliding fit with a matching inner diameter in the central bore of the shaft; this maintains coaxial alignment of the nose retainer and the shaft. Above the cylindrical segment 48, an outwardly projecting flange 52 seats against the punch sleeve ledge 40. An annular recess 54 above the flange 52 has strain gauges 29 applied thereto for measuring axial force transmitted from the punch nose 26 through the nose retainer. Preferably, at least four gauges are used to provide a full bridge configuration, which compensates for bending moments and thermal and other extraneous effects in the measure of axial load. Other strain gauges 31, as may best be seen in FIG. 9, are located circumferentially between the strain gauges 29 used to measure axial force. These strain gauges 31 are used for measuring bending caused by nonuniform loading of the punch nose. These additional gauges are circumferentially wired in a quarter bridge configuration. Bending applied to the punch nose is transferred to the nose retainer 24, where it causes an additional tensile stress on one side of the retainer, with an equal additional compressive stress on the opposite side. The stresses thus produced can be measured by the individual strain gauges 31 affixed on the outer diameter of the nose retainer, in addition to those gauges wired as a full bridge to measure mean axial load. One skilled in the art of experimental stress analysis can easily convert these individual stresses to the load variation which produced them. Similarly, imbalanced load on the punch body is transferred to the mandrel as a bending load, and can be detected by individual strain gauges affixed on the outer diameter of the mandrel, in addition to those wired as a full bridge to measure mean axial load. The upper end of the nose retainer is adapted to support the punch nose 26; a counterbore 56 is provided to receive the punch nose 26 and three tapped holes 58 are provided for attaching the punch nose thereto. The punch nose 26 shown in FIGS. 4 and 5 is an axisymmetric solid having a cylindrical bottom portion 60 with a diameter slightly less than the counterbore 56 in the retainer 24 to effect a close sliding fit between the retainer and punch nose, and thus maintain coaxial alignment of the punch nose and the nose retainer. Above the bottom portion 60, a central portion 62 flares outwardly to fit within the inwardly tapering open end of the sleeve 22. For reasons to be discussed later, it is important that the dimensional relationship between the sleeve 22 and nose 26 is such that a gap 64 is maintained between the sleeve 22 and nose 26 during the entire sequence of drawing and ironing a workpiece. The upper or outer end of the nose has a peripheral curvilinear surface 66 having a profile to form the desired bottom edge on the can body. A centerbore 68 extends through the nose and the upper end has a counterbore 70 to accommodate forming an inwardly projecting dome in the end of the can body with a doming tool (not shown). Three counterbored holes 72 are provided for the bolts 74 used in mounting the punch nose 26 to the nose retainer 24. Three additional tapped holes 76 are provided to disassemble the punch nose from the counterbore 56 of the retainer. Thus, the punch nose 26 is in coaxial alignment with the retainer 24 which, in turn, is in coaxial alignment with the shaft 30 of the mandrel 28. Since the punch sleeve is also in coaxial alignment to the shaft due to a close sliding fit, concentricity is assured between the adjacent outer edges of the punch sleeve and the punch nose. This is essential to avoid a discontinuity in the punch surface, which may lead to a fracture of the can during forming.

In assembling the punch 12, a punch body 23 is formed by sliding the sleeve 22 over the shaft 30 to rest upon the shoulder 38. The nose retainer 24 is threaded into the tapped central bore 44 of the shaft 30, pressing the retainer's flange 52 against the sleeve's ledge 40, thus clamping the sleeve 22 against the shoulder 38 of the shaft 30. The electrical leads 36 from the strain gauges 29, 31 pass through the retainer and shaft central bore 34 to a power source and a meter or recording device. The strain gauges are a well-known device through which a DC electrical current is passed for determining forces by measuring strains imposed upon material to which they are adhered and are positioned on the recessed portion 54 of the nose retainer 24. Force on the retainer causes a corresponding change in voltage across the gauges which may be indicated on a dial or recorder. Such dial or recorder can be calibrated to give a reading or recordation of the magnitude of the force on the retainer 24 which causes the change in voltage. The punch nose 26 is seated in the counterbore 56 of the retainer and attached thereto with the bolts 74. As has been noted earlier, it is important that a gap 64 is maintained between the punch nose 26 and sleeve 22, preventing contact during loading of the punch body 23. The resulting gap between the adjacent ends of the punch sleeve 22 and the punch nose 26 does not cause forming problems during redrawing or ironing since the gap is small and, at this location, only slight thickness reductions are made in the can sidewall. The gap 64 ensures that all axial and bending loads applied to the punch nose 26 are directly transferred to the retainer 24, where they are detected and measured by its strain gauges 29, 31. It is also to be noted that a tight fit between outer surface portions of the retainer and inner surface portions of the sleeve is to be avoided to ensure that no load sustained by the punch sleeve 22 is transferred to the retainer which would falsely increase the punch nose load reading.

It will be apparent to those skilled in the art that numerous variations of the illustrated details may be made without departing from this invention. A very similar punch design is also appropriate for measuring punch friction and sidewall tension in the initial drawing process, with the primary difference that the punch is larger in outer diameter and much shorter, commensurate with the geometry of the workpiece formed. Therefore, the following discussion related to redrawing and ironing applies equally well to drawing.

To form a can body by a method of this invention, a cup is first drawn from a circular sheet blank. The punch 12 is withdrawn from the ironing dies 16, 18, 20 and the redraw die 14 a sufficient distance to mount a drawn cup in a redraw sleeve (not shown here), which coaxially aligns the cup with the punch and presses the end wall of the cup against the die face during redrawing to prevent flange wrinkling. The traverse of the cup through the redraw die and ironing dies is begun by applying a force to the base of the punch. In a first forming step, the cup is reduced in diameter to the inside diameter of the redraw die 14 as the punch forces it through the redraw die opening. In drawing or redrawing, there is a natural tendency of the metal to thicken as it is reduced in diameter; this thickening increases with larger reductions in diameter. Therefore, the resulting redrawn sidewall becomes thicker toward the top of the redrawn cup. Often, in commercial can body production, this thickening is offset by specifying the clearance between the sleeve 22 and the redraw die 14 as nominally the original sheet thickness. This wall thickness control, or "sizing", is actually an ironing performed with the redraw die. This additional deformation substantially increases friction between the workpiece sidewall and the punch, necessitating the application of the method of this invention to accurately determine the sidewall stress during redrawing. This applies equally well to the initial draw process, where sizing is also frequently employed.

During redrawing or ironing, the axial force required to deform the material at the die is supplied by the tension in the reformed sidewall, pulling the material through the die, and by friction between the punch and the deforming material, acting to push the material through the die. The sidewall tension is largely transferred to the cup bottom, which then exerts a force on the punch nose 26. As previously mentioned, a weaker friction between the reformed sidewall and the punch acts to reduce the sidewall tension, from a maximum at the die exit to a minimum at the punch nose. The method of this invention enables the determination of magnitude of this friction, so that the measured punch nose force can be corrected for this friction to obtain a true value of sidewall tension at the die exit. The force applied to the punch nose 26 is transferred to the nose retainer 24 and to the shaft 30. The friction applied to the punch sleeve is directly transferred to the shaft 30. The strain on the retainer 24, a known function of the causative load which is transferred to the end wall of the cup, is monitored by a high speed recording device connected to the electrical leads 36. Strain on the central mandrel 28 developed by the force applied to the punch base is detected by strain gauges 78 affixed to the outer diameter of the mandrel's cylindrical base 32, and is also monitored by the recorder. Preferably, at least four gauges 78 equally spaced circumferentially around the punch base 32 are used to provide a full bridge configuration, which compensates for bending moments and thermal and other extraneous effects in the measure of axial load. Bending at the punch base is measured with four additional gauges attached to the punch base between the axial force gauges 78. The bending gauges are wired in a quarter bridge configuration.

As an alternate embodiment, a commercially available load cell, designed on the same measurement principles described here, may instead be serially mounted between the central mandrel 28 and the press.

The recorder also monitors the travel of the punch 12 by a Linear Variable Differential Transformer or other displacement transducer, providing an electrical output signal proportional to punch position. Thus, the punch nose force, i.e., the force on the retainer 24, and the punch base force, i.e., the force on the mandrel's base 32, as well as associated bending forces due to uneven radial or axial loads, can be deteimined with respect to any given position of the workpiece as it travels through the tooling.

As the punch and workpiece pass through the first ironing die 16, the wall is reduced in thickness and the sidewall lengthened, generating a substantial frictional force between the sleeve 22 and the deforming workpiece material 10 at the die, which assists the deformation. A weaker friction between the reformed sidewall and punch sleeve acts to reduce sidewall tension further away from the die. The punch base force required to drive the can body 10 through the ironing die 16 is composed of force applied to the punch nose 26 due to sidewall tension at the nose, and of the frictional force between the punch 12 and the can body sidewall. To reduce sidewall tension, and so, reduce fracture frequency, the force required to deform the material must be decreased or the share supplied by punch friction must be increased. As noted earlier, maintaining a gap between the punch nose 26 and the punch sleeve 22 is critical. It can be seen that if the punch nose 26 is entirely supported by the retainer 24, then the force monitored at the retainer is the total force inducing tension in the can sidewall adjacent to the gap between punch nose 26 and punch sleeve 22. The tension in the sidewall as it exits the zone of deformation of the redraw die 14 or any of the ironing dies 16, 18, 20 then equals this measured force plus the friction acting between the punch and the reformed segment of the sidewall. The final value of this friction can be accurately determined from the residual force exerted on the retainer 24 after the can has completely exited the die. This frictional force maintains the sidewall in tension, resisting the elastic recovery of the reformed sidewall, and is generated from the pressure exerted as the punch elastically recovers from the compression from ironing by reexpanding within the reformed article. The corresponding frictional stress can be assumed relatively uniform over the area of the inside surface of the reformed sidewall. Therefore, the value of this frictional force at previous instances of the process can be deduced from the final frictional force, since the frictional force is proportional to sidewall surface area.

Since the tensile stress in the sidewall is derived by dividing the tension force by the cross-sectional area of the sidewall, it may also be seen that as the wall gets progressively thinner, errors in determination of the tensile force have an ever-increasing adverse effect on accuracy of the computed tensile stress. The final wall thickness of an aluminum beverage container is typically 0.0045 inch, and the trend in the can-making industry is toward thinner sidewalls and higher thickness reductions. In FIG. 1, therefore, the sidewall as it exits ironing die 20 is very thin and has a correspondingly small cross-sectional area. It is evident that even a small change in the tension force has a very substantial impact on the computed tensile stress. Further, it has been found that, due to punch friction, the punch nose force is substantially less than the punch base force, so that punch base force provides a false value in determining sidewall tensile stress. By isolating and measuring only the force on the punch nose 26, and adding the small correction of the reformed sidewall friction, the tensile stress in the sidewall at the die exit can be determined with a degree of accuracy not known heretofore. If the sidewall tensile stress at the gap 64 is not uniform, a bending load will be exerted on the punch nose. This bending will be transferred to the nose retainer and measured in two or more lateral directions by separate strain gauges, configured as described above. By measuring this bending in two directions, the distribution of sidewall tension can be determined. In this way, the fracture initiation point can be located around the circumference, since the sidewall tension will decrease there first, creating a bending moment. Further, distribution of sidewall tension during forming provides an indicator of process nonuniformity, allowing diagnosis of press or tooling problems before they become severe enough to cause a fracture. By using this as feedback for a process control system, the process can be improved or optimized to minimize sidewall tension and variation of tension around the circumference of the can.

This invention also enables determination of the magnitude and circumferential distribution of another important force. Since the total force on the punch measured by the strain gauges 78 is composed of the punch nose force and the frictional resistance along the punch, this friction force can be determined by subtracting the punch nose force as measured at the retainer 24 from the punch base force at the corresponding circumferential location, determined from axial and bending loads measured by strain gauges 78. This total punch friction can be separated into two distinct components: an intense punch friction localized at the die and a weaker punch friction distributed over the length of the reformed sidewall. As previously shown, reformed sidewall friction at any point in the process can be deduced from the residual sidewall tension after forming. Such reformed sidewall friction is equal to the final friction times the ratio of the current reformed sidewall area to the final sidewall area. Knowledge of the reformed sidewall friction applies to the important process of stripping the can from the punch. Stripping presents a limitation to increasing punch friction during the ironing process, since reformed sidewall friction also increases, raising stripping forces until the can is damaged by removal from the punch. Stripping force and its variation around the can is monitored by the method of this invention by measuring punch base force and bending during this final process in the return stroke of the punch. Knowing the magnitude of both components of the punch friction force is helpful in understanding the tradeoff in increasing punch friction, and determining the effects of such factors as lubricants, punch speed, and surface finish of the punch and workpiece material from which the can body is being formed, for example.

Figure 6:
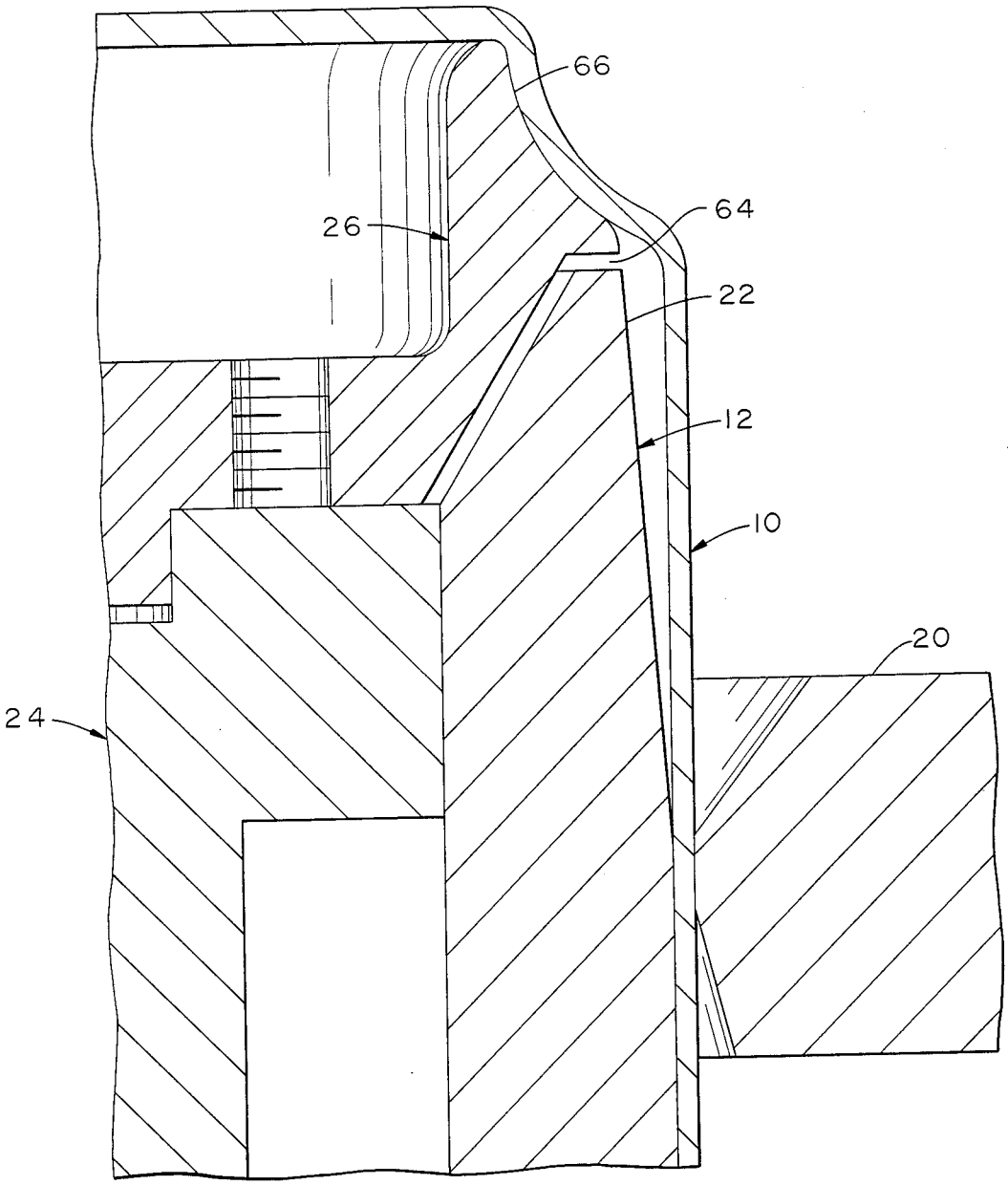
FIG. 6 is a cross-sectional view of a fragmentary portion of a punch of this invention with a drawn and partially ironed workpiece thereon.

An important feature of the punch for successful use of the invention is shown in FIG. 6. For production of most commercial can designs, the outer diameter of the punch 12 typically tapers inwardly from the nominal ironing diameter so that less ironing of the sidewall occurs for a short distance from the end wall of the can body 10. This leaves the sidewall thicker in the bottom region, strengthening the can. In the apparatus of this invention, the gap 64 between the punch nose 26 and punch sleeve 22 is located near the end of the punch 12 where this lesser ironing reduction is made. The outside diameter of the punch nose 26 and the punch sleeve 22 at the gap between the nose and sleeve is slightly smaller than the nominal ironing diameter of the sleeve. This design feature avoids causing a sidewall tearoff by ironing over this discontinuity between the punch nose 26 and punch sleeve 22. Similarly, extrusion of sidewall material into the gap during ironing is avoided, which would otherwise alter the measurement of punch nose load and modify the forming process. In addition, the gap between punch nose 26 and sleeve 22 is located such that the tangent of the curvilinear profile 66 of the outside corner of the punch nose is substantially parallel to the length of the punch sleeve 22. For the method of this invention, this geometry maximizes sensitivity in measuring sidewall tension, i.e., output volts from the device measuring punch nose load per pound of sidewall tension, for any given transducer and recording equipment used. For this configuration, the punch nose load equals the sidewall tension. At any other angle of the tangent to the length of the punch sleeve, the punch nose load is lower than the sidewall tension, so there is a corresponding reduction in punch nose load cell sensitivity to sidewall tension; punch nose load must then be multiplied by the secant of this angle to obtain sidewall tension. Since measurement devices have a minimum threshold in detecting changes in voltage, this sensitivity relates directly to the minimum change in sidewall tension that can be detected;, therefore, it is desirable to maximize sensitivity to obtain the most accurate history of sidewall tension during the forming process.

In the preferred embodiment of this invention just discussed, the load on the punch nose was measured by using strain gauges affixed to the nose retainer 24. In an alternate embodiment, the punch can be adapted to incorporate a load cell for measuring the load on the punch nose.

Figure 7:
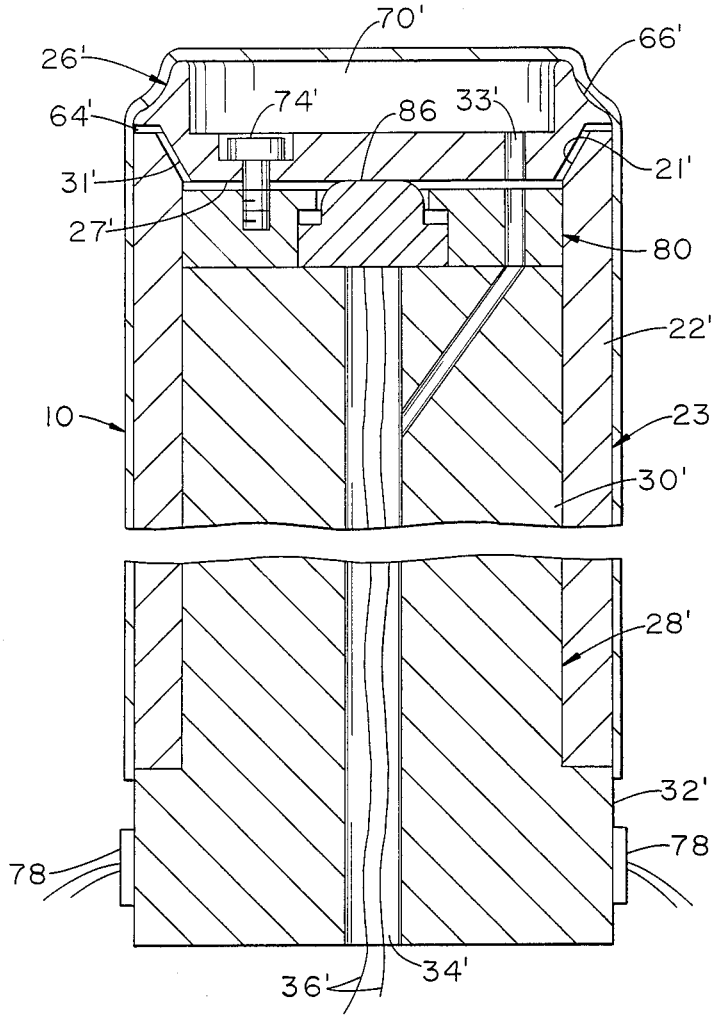
FIG. 7 is a cross-sectional view of an alternate embodiment of a punch of this invention.
Figure 8:
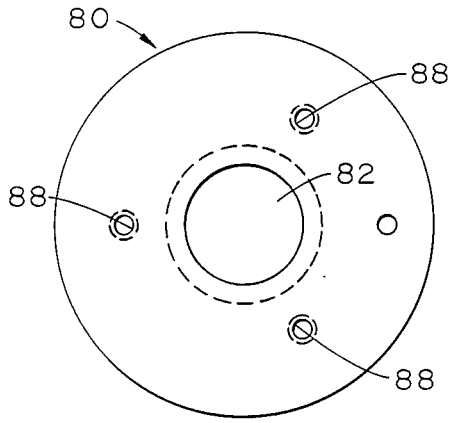
FIG. 8 is a top view of the punch nose retainer of the punch shown in FIG. 7.

Referring now to FIGS. 7 and 8, an alternate punch has a punch body 23 which includes a central mandrel 28', an outer sleeve 22' and a load cell retainer 80. The central mandrel 28' has an elongate cylindrical shaft 30' terminating in a cylindrical base 32' having a greater outside diameter than the shaft 30'. A cylindrical outer sleeve 22' circumscribes the cylindrical shaft 30' and is also supported by the cylindrical base member 32'. The inside surface 21' on a portion of the sleeve adjacent the nose end tapers outwardly. The load cell retainer 80 is a cylinder having a diameter which enables it to fit within the sleeve 22' and seat upon the top surface of the shaft 30'. A center bore 82 and counterbore 84 from the bottom are provided to accommodate a load cell 86, and three equiangular spaced tapped holes 88 are also provided for attachment of the punch nose 26'. The load cell 86 is a device known to those skilled in the art for measuring loads imposed thereon. The load cell fits within the retainer bore 82 and counterbore 84 and seats upon the shaft 30'. The nose of the load cell projects above the top surface of the retainer 80. The punch nose 26' is adapted to fit within the sleeve 22', assemble with the retainer 80 with bolts and rest upon or be supported by the nose of the load cell 86. The punch nose 26' has a bottom planar cylindrical surface 27' having a lesser diameter than the inside diameter of the sleeve 22'. An outer surface 31' slopes outwardly parallel to the sleeve tapering surface 21' with a gap 64' therebetween. The upper annular peripheral surface 66' has a curvilinear profile to produce the desired bottom edge shape on the can and a central cavity 70' is provided to accommodate a doming tool (not shown). Three equiangular spaced, bored and counterbored holes receive bolts 74' for attaching the nose to the retainer 80. In addition to the bolt holes, one or more additional holes 33' are provided through the nose to allow pressurized air to pass therethrough and force the finished can off of the punch. One or more passageways are also provided through the load cell retainer and shaft to carry and transfer the pressurized air through the nose.

With the punch of the alternate embodiment assembled as just described and shown in FIG. 7, the nose 26' is in contact with the punch only through the load cell 86. When the punch is loaded to force the workpiece 10 through the dies (not shown), the punch nose 26' becomes loaded as has been previously discussed with respect to the preferred embodiment and the imposed load is transferred to the load cell 86. As the load imposed on the cell 86 changes, a corresponding voltage change occurs which is indicated on a meter or recorder attached to the cell with electrical leads 36'. The total load on the punch is determined with strain gauges 78 attached to the punch base 32' as has been previously described.

While the invention has been described in terms of preferred embodiments, the claims appended hereto are intended to encompass all embodiments which fall within the spirit of the invention.

What is claimed is:

1. An apparatus for forming a hollow article having a closed end, comprising:

(a) a punch having a nose end and a base end;
(b) a die coaxially aligned with said punch;
(c) means for measuring bending on a portion of said punch extending away from said nose end; and
(d) means for measuring axial force imposed on said nose end in forcing a workpiece through said die to form a closed end hollow article.

2. The apparatus of claim 1 wherein said means for measuring bending extends away from said base end.

3. The apparatus of claim 2 wherein the means for measuring bending is at least one strain gauge attached to a peripheral surface of said punch adjacent said base end.

4. The apparatus of claim 1 which further includes means for measuring a total axial force imposed on said punch in forcing a workpiece through said die.

5. The apparatus of claim 4 wherein said means for measuring the total force on said punch is a strain gauge attached to a peripheral surface of said punch.

6. The apparatus of claim 5 wherein said strain gauge is attached to said base end of said punch.

7. The apparatus of claim 1 wherein said punch includes a body, and said nose end is attached to said body so as to provide a gap therebetween.

8. The apparatus of claim 7 wherein said nose end has a portion in contact with said body, and said means for measuring the axial force imposed on said nose end is a strain gauge attached to the portion of said body which is contacted by said nose end.

9. The apparatus of claim 7 wherein said means for measuring bending is a strain gauge attached to the portion of said body which is contacted by said nose.

10. The apparatus of claim 7 wherein said means for measuring the load imposed on said nose end is a load cell interposed between said nose end and said body with said nose end and contact with said load cell and said load cell being supported by said body.

11. The apparatus of claim 10 wherein said nose end includes means for passing air therethrough to force the workpiece from said punch after forming.

12. The apparatus of claim 1 wherein said punch includes a portion adjacent said nose end which tapers downwardly and outwardly therefrom.

13. The apparatus of claim 12 wherein said nose end includes a curvilinear annular peripheral surface, and a tangent at the outermost point on such surface is substantially parallel to the outer surface of said body.

14. A punch for forcing a workpiece through a die to make a hollow cylinderical article having a closed end, comprising:

(a) a hollow cylinderical mandrel having a nose end and a base end;

(b) a hollow cylinderical sleeve circumscribing at least a portion of said mandrel;

(c) a hollow cylinderical nose retainer coaxially aligned with said mandrel and attached to said nose end, said nose end havinf an intermediate portion with a circumferential recess suitable for attaching a strain gauge therein; and (d) a punch nose coaxially aligned with said retainer and attached thereto.

15. A punch for forcing a workpiece through a die to make a hollow cylindercal article having a closed end, comprising:

(a) a hollow cylindrical mandrel having a nose end and a base end;

(b) a hollow cylindrical sleeve circumscribing at least a portion of said mandrel;

(c) a load cell coaxially aligned with and supported on said nose end of said mandrel; and (d) a punch nose spaced apart from said mandrel in coaxial alignment with said mandrel and in contact with said load cell.

16. A method of forming a hollow cylinderical article having a closed end, said method comprising the steps of:

(a) providing a punch having a nose end and a base end in coazial alignment with a die;

(b) inserting a blank between said punch and said die;

(c) contacting said blank with said nose end of said punch and forcing said blank through said die;

(d) providing means for measuring the axial load on said nose end necessary to force said blank through said die and (e) providing means for measuring bending on a portion of said punch extending away from said nose end.

17. The method of claim 16 wherein said means for measuring bending on a portion of said punch extends away from said base end.

18. The method of claim 16 wherein said means for measuring the axial load on said nose end comprises locating a load cell between a spaced apart nose portion and a mandrel portion of said punch whereby the load on said nose end is transferred to said load cell.

19. The method of claim 16 wherein said means for measuring the axial load on said nose end includes providing a punch having a central mandrel and attaching at least one strain gauge to a portion thereof which is strained only from a load imposed on said nose end.

20. The method of claim 19 wherein said punch has sufficient strain gauges attached to said central mandrel which are strained only from a load imposed on said nose end to measure the strain from bending a portion of said punch extending away from said nose end.

21. The method of claim 20 which includes providing sufficient strain gauges on a portion of said punch near said base end to measure the bending on a punch portion extending away from said base end.

22. The method of claim 16 which includes providing means for measuring the total axial load imposed on said punch.

23. The method of claim 22 wherein said means for measuring total axial load comprises attaching at least one strain gauge to a surface portion of the base end of said punch.

* * * * *